US007239822B2

(12) United States Patent
Douglas et al.

(10) Patent No.: US 7,239,822 B2
(45) Date of Patent: Jul. 3, 2007

(54) FINISHING SYSTEM

(75) Inventors: Wilbert D. Douglas, Pittsford, NY (US); Douglas F. Sundquist, Webster, NY (US); Natasha A. Gitany-Alonso, Mayaguez, PR (US); Michael A. Wiegand, Webster, NY (US)

(73) Assignee: Xerox Corporation, Stamford, CT (US)

( * ) Notice: Subject to any disclaimer, the term of this patent is extended or adjusted under 35 U.S.C. 154(b) by 156 days.

(21) Appl. No.: 11/116,811

(22) Filed: Apr. 28, 2005

(65) Prior Publication Data

US 2006/0245781 A1 Nov. 2, 2006

(51) Int. Cl.
*G03G 15/00* (2006.01)

(52) U.S. Cl. ..... 399/82; 399/16; 399/81; 399/407

(58) Field of Classification Search ..... 399/81, 399/82, 16, 410, 407, 361, 367; 270/37, 270/58.08
See application file for complete search history.

(56) References Cited

U.S. PATENT DOCUMENTS 6,091,929 A 7/2000 Yamazaki et al.
6,144,818 A * 11/2000 Ohtani ..... 399/81
6,430,389 B1 * 8/2002 Kimura ..... 399/410
6,711,365 B2 * 3/2004 Ohtani ..... 399/82
6,799,759 B1 10/2004 McNamara et al.
6,819,906 B1 11/2004 Herrmann et al.
6,868,253 B2 * 3/2005 Ueda et al. ..... 399/407
6,952,542 B1 * 10/2005 Morikawa ..... 399/81
2001/0026699 A1 * 10/2001 Ishikura ..... 399/81
2004/0130744 A1 * 7/2004 Wu et al. ..... 358/1.15
2005/0158068 A1 * 7/2005 Nakamura et al. ..... 399/82

FOREIGN PATENT DOCUMENTS

JP 11-038712 A * 2/1999

* cited by examiner

*Primary Examiner*—Sophia S. Chen

(57) ABSTRACT

An improvement in a finishing system that eliminates 'cut and try' by a user in trying to place staples in copy sheet sets in a desired position includes using input media orientation and the user's Finishing Selection to determine stapling position on output copy sheets.

13 Claims, 5 Drawing Sheets

FINISHING SYSTEM

This invention relates in general to an image forming apparatus, and more particularly, to an image forming apparatus employing an improved finishing system.

Typically, in an electrophotographic printing process of printers, such as, U.S. Pat. No. 6,091,929, which is incorporated herein by reference to the extent necessary to practice the present disclosure, a photoconductive member is charged to a substantially uniform potential so as to sensitize the surface thereof. The charged portion of the photoconductive member is exposed to selectively dissipate the charges thereon in the irradiated areas. This records an electrostatic latent image on the photoconductive member. After the electrostatic latent image is recorded on the photoconductive member, the latent image is developed by bringing a developer material into contact therewith. Generally, the developer material comprises toner particles adhering triboelectrically to carrier granules. The toner particles are attracted from the carrier granules either to a donor roll or to a latent image on the photoconductive member. The toner attracted to the donor roll is then deposited on latent electrostatic images on a charge retentive surface, which is usually a photoreceptor. The toner powder image is then transferred from the photoconductive member to a copy substrate. The toner particles are heated to permanently affix the powder image to the copy substrate.

In order to fix or fuse the toner material onto a support member permanently by heat, it is necessary to elevate the temperature of the toner material to a point at which constituents of the toner material coalesce and become tacky. This action causes the toner to flow, to some extent, onto fibers or pores of the support members or otherwise upon surfaces thereof. Thereafter, as the toner materials cool, solidification of the toner materials occurs causing the toner material to be bonded firmly to the support member.

A finisher is usually arranged in a post processing position to receive the fused copy substrates or sheets and staple them, if desired. In such finishing, any of 4 corners of the substrates is designated single position stapling (corner stapling), and any of 4 sides of the substrates is designated dual position stapling (lateral stapling).

It is necessary, in order to meet the above-mentioned variable designation of stapling positions, that the finisher be structured so that the stapling process can be conducted on any of 4 corners or 4 sides of the substrates. However, to meet these requirements, there is a problem in that the structure of the staple mechanism becomes more complicated, cumbersome and costly.

In addition, at present, there appears to be no automatic document feeder (ADF) that allows a user to select the position of a document in the ADF that corresponds to the output orientation of a copy substrate which would allow for placement of single or dual staples in most desired locations on a copy substrate set.

One attempt at solving this problem is in U.S. Pat. No. 6,091,929 B1, issued Jul. 18, 2000 to Hirohiko Yamazaki et al. which discloses an image forming apparatus provided with an image reader to read an image on an image surface of a document and to output image data corresponding to the image. An image processor is included to process the image data and an image forming device is provided to successively form imaged on sheets on the basis of the processed image data. A post processing device includes a stapling stand on which the sheets are placed and a stapler to staple at a predetermined position on the stapling stand, wherein the predetermined position locates at only a single side of the sheet placed on the stapling stand. A stapling position selector is included to select a stapling position on the image formed onto the sheets, wherein the image processor processes the image data so that when the sheets are placed on the stapling stand, the stapling position of the image formed on the sheets selected by the stapling position selector coincides with the predetermined position of the stapling stand.

While this patent answered some of the above-mentioned problems, it is still left up to the user to make sure that the combination of the orientation of the input image and of its substrate, coupled with the output paper orientation and the finisher selection, will place a single staple in the desired orientation. With any 'unusual' combination, it will often take the user two or more experimental attempts to get the desired output. Each unsuccessful attempt creates waste and requires time to 'retry' with a different combination of selections and orientations. Staple orientation is not offered as a single option.

Obviously, there is still a need for a reprographic device that uses finishing selection to select staple alignment orientation.

Accordingly, an improved finishing system is disclosed that provides the user with a choice for staple alignment orientation, in addition to staple position, coupled with automatic image rotation and automatic input media substrate selection. Thus, the experimental 'cut and try' approach required to give the user what is desired is eliminated, as is the waste produced by the unsuccessful attempts and the time required to retry with a different combination of selections.

The disclosed system may be operated by and controlled by appropriate operation of conventional control systems. It is well known and preferable to program and execute imaging, printing, paper handling, and other control functions and logic with software instructions for conventional or general purpose microprocessors, as taught by numerous prior patents and commercial products. Such programming or software may, of course, vary depending on the particular functions, software type, and microprocessor or other computer system utilized, but will be available to, or readily programmable without undue experimentation from, functional descriptions, such as, those provided herein, and/or prior knowledge of functions which are conventional, together with general knowledge in the software of computer arts. Alternatively, any disclosed control system or method may be implemented partially or fully in hardware, using standard logic circuits or single chip VLSI designs.

The term 'printer' or 'reproduction apparatus' as used herein broadly encompasses various printers, copiers or multifunction machines or systems, xerographic or otherwise, unless otherwise defined in a claim. The term 'sheet' herein refers to any flimsy physical sheet or paper, plastic, or other useable physical substrate for printing images thereon, whether precut or initially web fed. A compiled collated set of printed output sheets may be alternatively referred to as a document, booklet, or the like. It is also known to use interposes or inserters to add covers or other inserts to the compiled sets.

As to specific components of the subject apparatus or methods, or alternatives therefor, it will be appreciated that, as normally the case, some such components are known per se' in other apparatus or applications, which may be additionally or alternatively used herein, including those from art cited herein. For example, it will be appreciated by respective engineers and others that many of the particular components mountings, component actuations, or component drive systems illustrated herein are merely exemplary, and that the same novel motions and functions can be provided by many other known or readily available alternatives. All cited references, and their references, are incorporated by reference herein where appropriate for teachings of additional or alternative details, features, and/or technical background. What is well known to those skilled in the art need not be described herein.

Various of the above-mentioned and further features and advantages will be apparent to those skilled in the art from the specific embodiments, including the drawing figures (which are approximately to scale) wherein.

Figure 1:
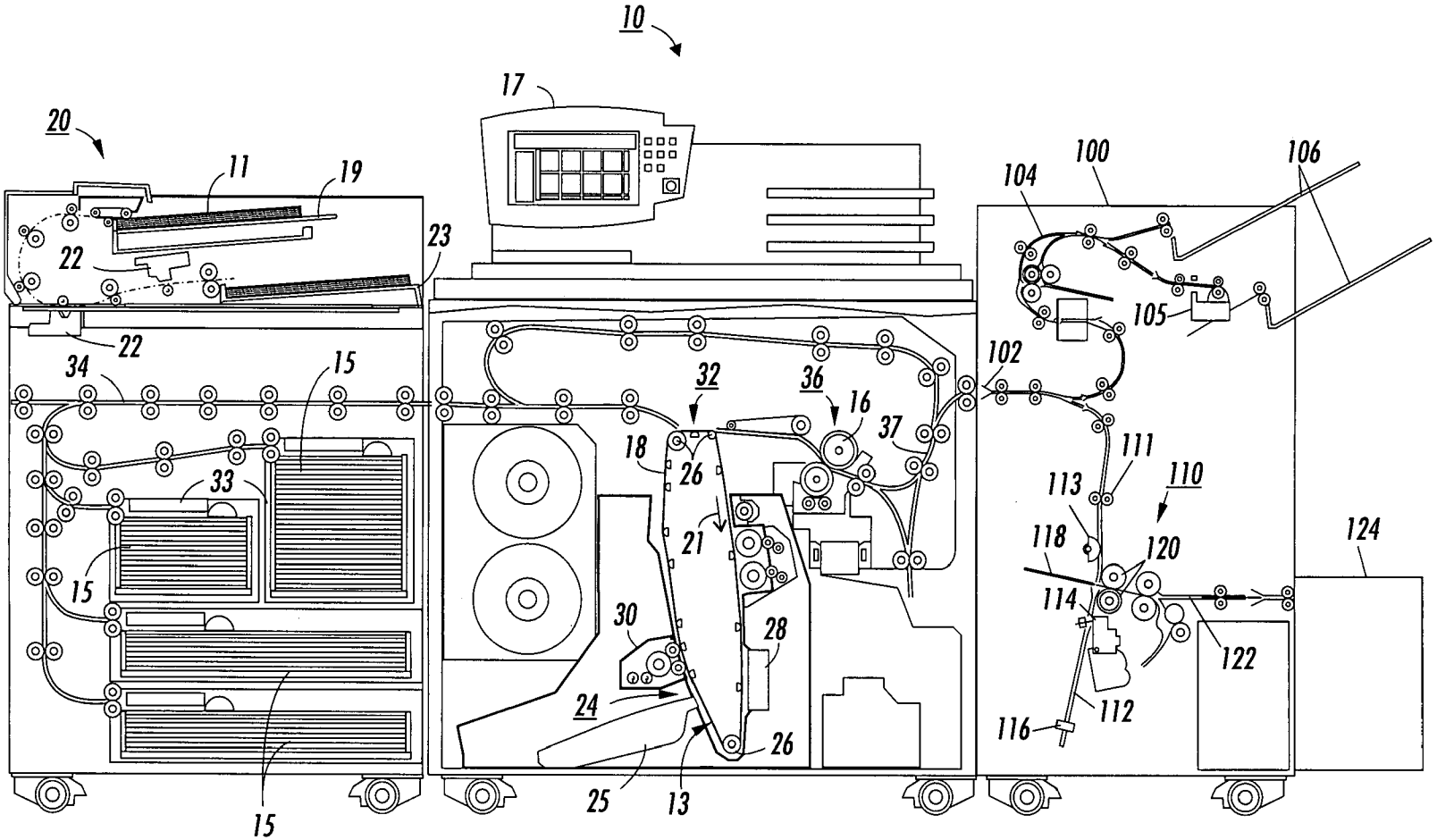
FIG. 1 is an exemplary modular xerographic printer that includes an exemplary finisher system in accordance with the present disclosure.

While the disclosure will be described hereinafter in connection with a preferred embodiment thereof, it will be understood that limiting the disclosure to that embodiment is not intended. On the contrary, it is intended to cover all alternatives, modifications and equivalents as may be included within the spirit and scope of the disclosure as defined by the appended claims.

The disclosure will now be described by reference to a preferred embodiment xerographic printing apparatus that includes an improved finishing system.

For a general understanding of the features of the disclosure, reference is made to the drawings. In the drawings, like reference numerals have been used throughout to identify identical elements.

Referring to the FIG. 1 printer 10, as in other xerographic machines, such as, in U.S. Pat. No. 6,819,906 issued Douglas Herrmann et al. on Nov. 16, 2004, which is included herein by reference, an electronic document or an electronic or optical image of an original document or set of documents to be reproduced may be projected or scanned onto a charged surface 13 or a photoreceptor belt 18 to form an electrostatic latent image. Optionally, an automatic document feeder 20 (ADF) may be provided to scan at a scanning station 22 paper documents 11 fed from a tray 19 to a tray 23. The latent image is developed with developing material to form a toner image corresponding to the latent image. The toner image is then electrostatically transferred to a final print media material, such as, paper sheets 15, to which it may be permanently fixed by a fusing device 16. The machine user may enter the desired printing and finishing instructions through the graphic user interface (GUI) or control panel 17, or, with a job ticket, an electronic print job description from a remote source, or otherwise.

As the substrate passes out of the nip, it is generally self-stripping except for a very lightweight one. The substrate requires a guide to lead it away from the fuser roll. After separating from the fuser roll, the substrate is free to move along a predetermined path toward the exit of the printer 10 in which the fuser structure apparatus is to utilized.

The belt photoreceptor 18 here is mounted on a set of rollers 26. At least one of the rollers is driven to move the photoreceptor in the direction indicated by arrow 21 past the various other known xerographic processing stations, here a charging station 28, imaging station 24 (for a raster scan laser system 25), developing station 30, and transfer station 32. A sheet 15 is fed from a selected paper tray supply 33 to a sheet transport 34 for travel to the transfer station 32. Paper trays 33 include trays adapted to feed the long edge of sheets first from a tray (LEF) or short edge first (SEF) in order to coincide with the LEF or SEF orientation of documents fed from tray 19 that is adapted to feed documents LEF or SEF depending on a user's desires. Transfer of the toner image to the sheet is effected and the sheet is stripped from the photoreceptor and conveyed to a fusing station 36 having fusing device 16 where the toner image is fused to the sheet. The sheet 15 is then transported by a sheet output transport 37 to the finishing station 100 where plural sheets 15 may be accumulated to be compiled into superposed sets or sheets and optionally fastened together (finished) by being stapled, folded, bound, or the like.

With further reference to FIG. 1, a simplified elevational view of a finisher module, generally indicated as 100, is shown that includes a booklet maker. This multi-functional finisher can be of the type described in U.S. Pat. No. 6,799,759 B1 issued Oct. 5, 2005 to Joseph M. McNamara et al. and included herein by reference. Printed signature sheets from the printer 10 are accepted in an entry port 102. Depending on the specific design of the finisher module 100, there may be numerous paths, such as, 104 and numerous output trays 106 for print sheets, corresponding to different desired actions, such as stapling, hole-punching and C or Z-folding. It is to be understood that various rollers and other devices which contact and handle sheets within finisher module 100 are driven by various motors, solenoids and other electromechanical devices (not shown), under a control system, such as including a microprocessor (not shown), within the finisher module 100, printer 10, or elsewhere, in a manner generally familiar in the art.

Multi-functional finisher 100 has a top tray 106 and a main tray 106 and a folding and booklet making section 110 that adds stapled and unstapled booklet making, and single sheet C-fold and Z-fold capabilities. The top tray 106 is used as a purge destination, as well as, a destination for the simplest of jobs that require no finishing and no collated stacking. The main tray 106 has a pair of pass-through 100 sheet upside down staplers 105 and is used for most jobs that require stacking or stapling, and the folding destination 110 is used to produce signature booklets, saddle stitched or not, and tri-folded. Sheets that are not to be C-folded, Z-folded or made into booklets or do not require stapling are forwarded along path 104 to top tray 106. Sheets that require stapling are forwarded along path 104, stapled at 105 and deposited into the main tray or lower tray of output trays 106. Conventional, spaced apart, staplers 105 are adapted to provide individual staple placement at either the inboard or outboard position of the sheets, as well as, the ability for dual stapling, where a staple is placed at both the inboard and outboard positions of the same sheets.

With booklet making as an example, folding and booklet maker 110 defines a slot, which is indicated as 112. Slot 112 accumulates signature sheets (sheets each having four page images thereon, for eventual folding into pages of the booklet) from the printer 10. Each sheet is held within slot 112 at a level where a stapler 114 can staple the sheets along a midline of the signatures, the midline corresponding to the eventual crease of the finished booklet. In order to hold sheets of a given size at the desired level relative to the stapler 114, there is provided at the bottom of the slot 112 an elevator 116, which forms a "floor" of the slot 112 on which the edges of the accumulating sheets rest before they are stapled. The elevator 116 is placed at different locations along slot 112 depending on the size of the incoming sheets, so that the trailing edge of the sheets will initially be adjacent the sheet ordering roll assembly 111. Also, elevator 116 is, for a given sheet size, movable (by means not shown, but typically including a motor or solenoid) among three positions, a first position where the trailing edge of the sheets are adjacent the sheet ordering roll assembly 111, a second position where the midpoint of the sheets are adjacent the stapler 114, and a third position, as will be described below. A flapper drive roll 113 penetrates into the path of slot 112 after each sheet is fed into slot 112, to ensure that the sheet is driven all the way to the backstop 116.

As the printed signature sheets are output from printer 10, elevator 116 is positioned so that the trailing edge of the output sheets (which would be at the top of slot 112) are disposed at sheet ordering roll assembly 111. When all of the necessary sheets to form a desired booklet are accumulated in slot 112, elevator 116 is moved from its first position to a second position where the midpoint of the sheets are adjacent the stapler 114. Stapler 114 is activated to place one or more staples along the midpoint of the sheets, where the booklet eventually will be folded.

After the stapling, elevator 116 is moved from its second position to a third position, where the midpoint of the sheets are adjacent a blade 118 and nip formed by crease rolls 120. The action of blade 118 and crease rolls 120 performs the final folding, and sharp creasing, of the sheets into the finished booklet. Blade 118 contacts the sheet set along the stapled midpoint thereof, and bends the sheet set toward the nip of crease rolls 120, which draws all of the sheets in and forms a sharp crease. The crease and stapled sheet sets then are drawn, by the rotation of crease rolls 120, completely through the nip, to form the final main fold in the finished booklet. The finished booklets are then conducted along path 122 and collected in a tray 124.

FIGS. 2-5 are directed to improved staple positioning in sheet output in finisher 100. Heretofore, staple positioning in sheet output appears to be limited. For example, in the diagram in FIG. 14 of U.S. Pat. No. 6,091,929, the staple position shown in row 1 is the same as row 3 with the diagram in row 3 being rotated 180°. The same appears true for rows 2 and 4. This appears to limit staple locations to the following: single staple position (portrait left, landscape left, portrait right and landscape right); dual staple position (left side portrait, left side landscape, top portrait and top landscape). In order to provide more staple locations, the improvements shown in FIGS. 2-5 are enabled by providing an ADF 20 that facilitates flexibility in orientation of input documents of either SEF or LEF (the preferred input orientation for scanned images, SEF for portrait or LEF for landscape). A label (not shown) reinforces these preferences on the automatic document feeder throat. Transfer sheets 15 are loaded into trays that feed sheets LEF or SEF to match the orientation of documents placed into the ADF. The proper tray, either SEF or LEF is automatically selected once documents are loaded into the ADF. Finishing selections offered to the user are described hereinafter as iconic displays in FIGS. 2-5. With manipulation of these displays on the GUI 17, regardless of the orientation of the original document, the system ultimately uses the finishing selection and delivers the desired output.

By providing a user with the combination of the ability to load original input documents into the ADF with either orientation of LEF or SEF with automatic selection of transfer sheet media fed from a proper tray of either SEF or LEF and the ability to rotate images 1800, the user will be able to choose from the following: single staple position (portrait left, landscape left, portrait right and landscape right); dual staple position (left side portrait, left side landscape, top portrait and top landscape); no finishing (portrait and landscape); and dual staple position (left side portrait, right side portrait, top portrait, bottom portrait, left side landscape, right side landscape, top landscape and bottom landscape).

Figure 2:
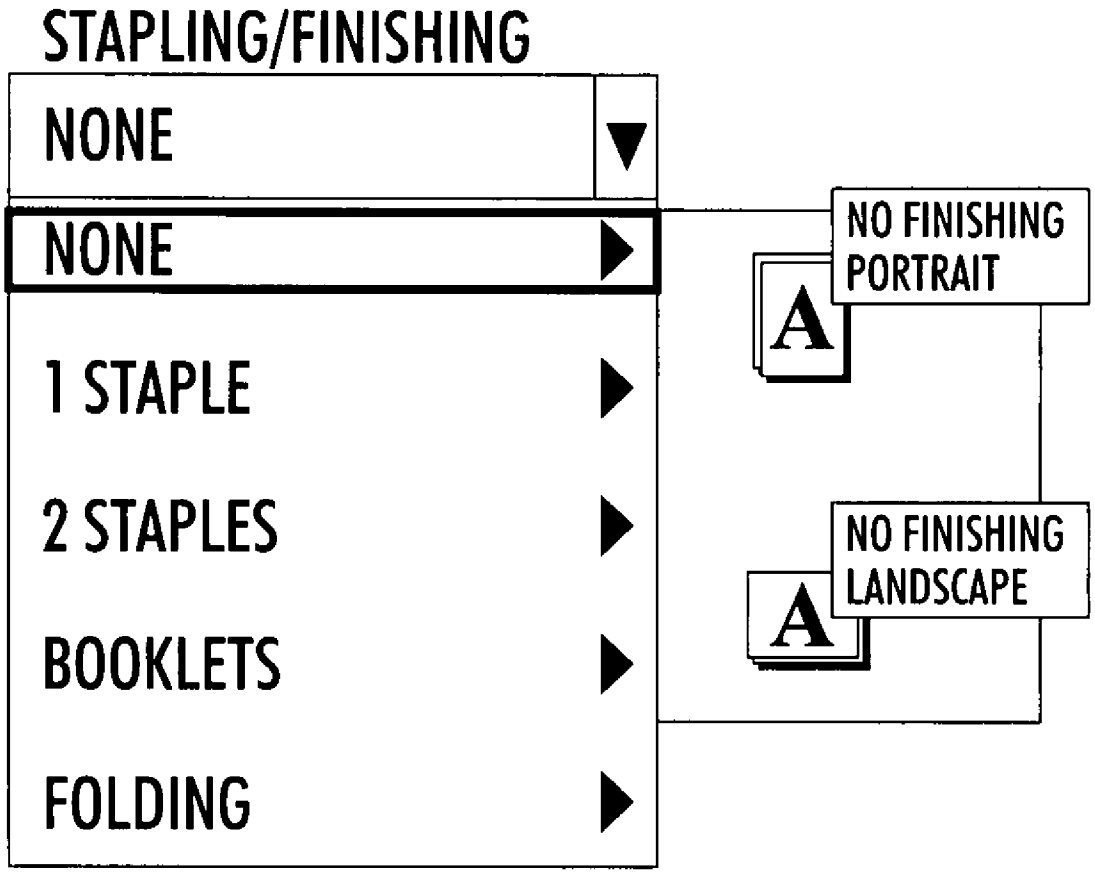
FIG. 2 shows an iconic display representation of finishing selections presented when a finishing dropdown is opened.
Figure 3:
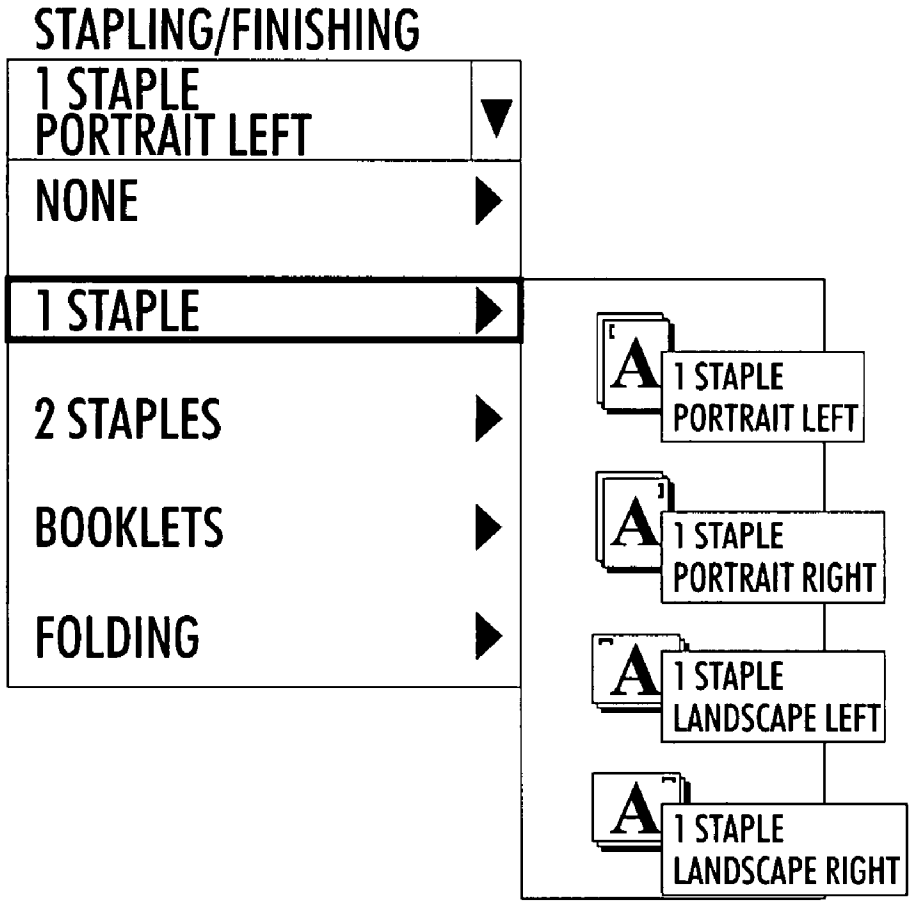
FIG. 3 shows an iconic display representation of finishing selections presented when a finishing dropdown is opened with fly out and one staple finishing selected.

For example, in FIG. 2, an initial iconic graphic is shown that appears when a user presses the finishing button on the GUI. A Finishing Dropdown opens with a default selection of None and a fly out opens to show No Finishing in either portrait or landscape. If one staple finishing is selected as shown in FIG. 3, a Finishing Dropdown opens with a fly out that shows the user what the stapled sheets will look like with a single staple in the upper left hand corner of one sheet set and upper right hand corner of another sheet set for portrait and a single staple in the upper left hand corner of a third sheet set and upper right hand corner of a fourth sheet set for landscape. Thus, a method of using the finishing selection (aided by iconic graphics) is disclosed that enables the user to select the orientation of the staple along a particular edge of the document set based on an iconic selection. The reprographic printing system takes into account the input original orientation of the LEF or SEF, manages the system's rotation of the image before marking, and automatically selects the correct paper feed tray media orientation of LEF or SEF to offer more stapling options and control the proper staple location(s).

Figure 4:
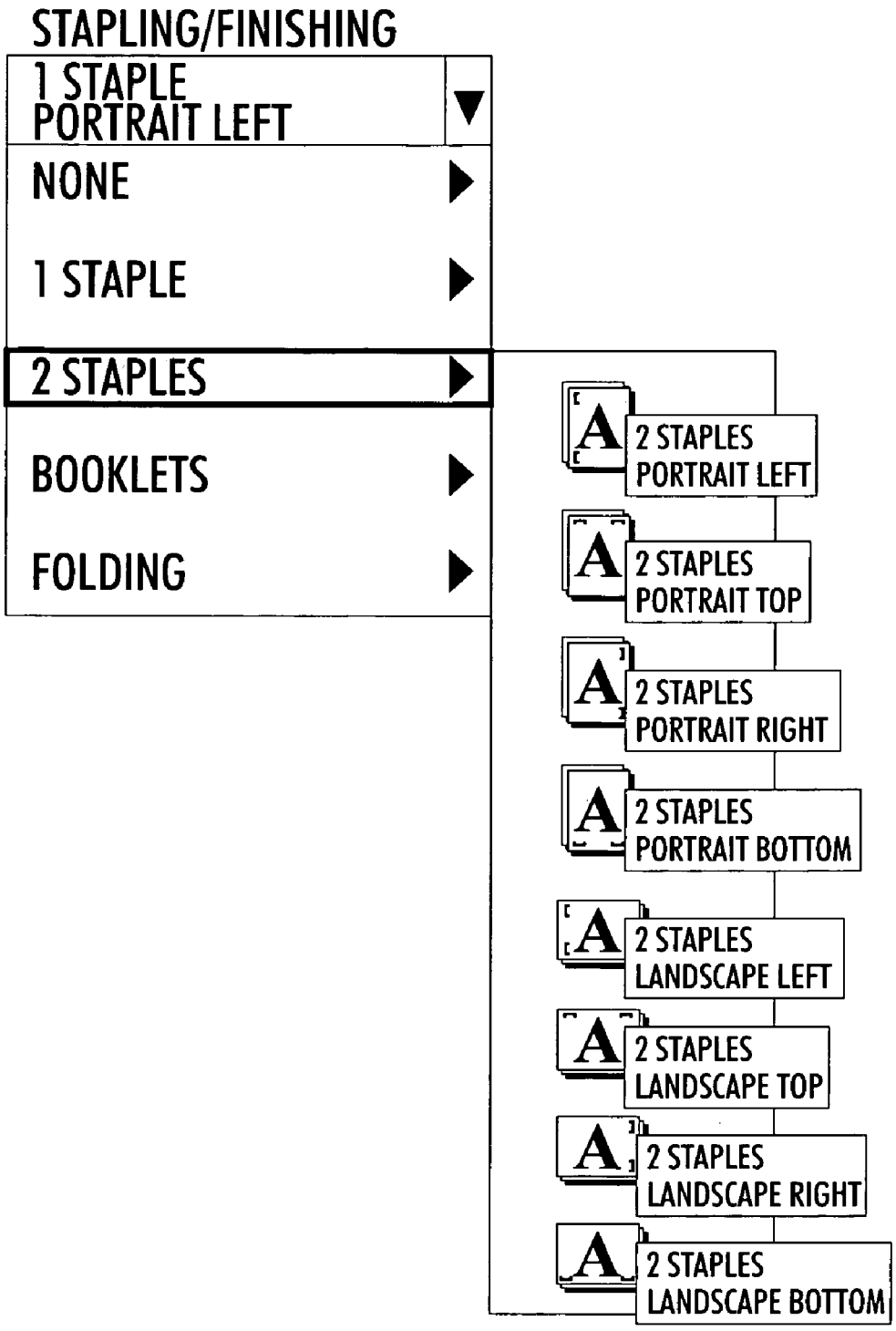
FIG. 4 shows an iconic display representation of finishing selections presented when a finishing dropdown is opened with fly out and two staple finishing selected.
Figure 5:
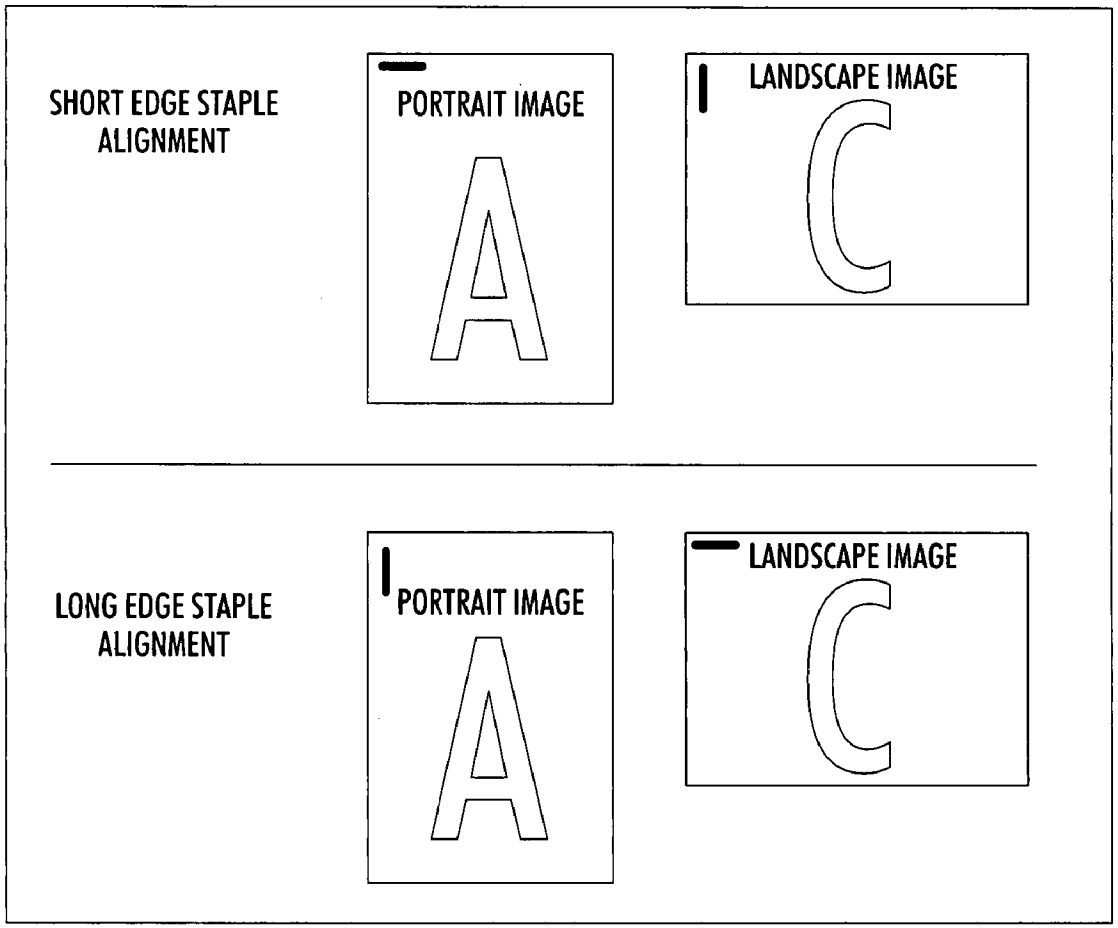
FIG. 5 is a plan view showing different staple orientations possible with the present disclosure.

With a user selection of two staples per sheet set as shown in FIG. 4, a Finishing Dropdown opens with a fly out depicting separate copy sheet sets with two staples in each of four sides (top, bottom, left and right sides) for portrait and landscape copy sheet sets. Another improvement available to a user is shown in FIG. 5. By using the Finishing Selection (aided by iconic graphics) a user is enabled to select the orientation of the staple along a particular edge of a copy sheet set based on the iconic selection. The reprographic printing system 10 takes into account the input original orientation of LEF or SEF, manages the system's rotation of the image before marking, and automatically selects the correct paper feed tray media orientation of LEF or SEF to offer more stapling options and control the proper staple location. For example, in FIG. 5, a single staple is shown orientated in short edge staple alignment in the upper left had corner of portrait and landscape copy sheet sets, as well as, long edge staple alignment in both portrait and landscape copy sheet sets. That is, the selectable orientations would be for staple alignment parallel to the short edge of the output copy sheet set or staple alignment parallel to the long edge of the output copy sheet set.

It should now be understood that an improvement has been disclosed that allows a user to choose the input document image orientation to be either SEF or LEF. With no finishing selection, the default document orientation for documents to be scanned through the ADF is SEF for portrait or LEF for landscape. A label on the ADF throat reinforces this preference. The orientation of the input original document is used in conjunction with: 1) the orientation of the input media substrate in the paper tray, to select the proper paper tray (either LEF or SEF) to satisfy the stapling selection; and 2) the Finishing Selection reporting to the printing system whether the input image is in the form of landscape or portrait. Regardless of the orientation of the input image, the system ultimately uses the Finishing Selection and delivers the desired output. When the user initiates printing, the printing system automatically determines what is required from the iconic staple alignment orientation information. The system will automatically: a) acquire image and orientation information of the original input document; b) select the proper source paper tray to meet the stapling selection, choice of LEF or SEF; c) induce situational rotation of the input image 0°, 90°, 180°, or 270° to meet the user's selection; and d) invoke the proper stapler head on the finisher. The result will match the user's desire, as indicated by the staple orientation and position selection. This system provides more stapling selections without adding confusion in the presentation to the user. In addition, it eliminates the 'cut and try' waste.

It will be appreciated that various of the above-disclosed and other features and functions, or alternatives thereof, may be desirably combined into many other different systems or applications. Also, that various presently unforeseen or unanticipated alternatives, modifications, variations or improvements therein may be subsequently made by those skilled in the art which are also intended to be encompassed by the following claims.

What is claimed is:

1. A reprographic device, comprising:

an automatic document handler that receives and feeds documents from a feed tray along a predetermined feed path with the documents positioned to be fed either short edge first or long edge first;

a scanning member positioned within said predetermined feed path to read an image on each document as it is passing and forwards image data;

an image processor that receives the image data from said scanning member and processing it;

a plurality of copy sheet feed trays adapted to feed copy sheets to receive images thereon from said image processor, said copy sheet feed trays including trays that feed copy sheets short edge first or long edge first, and wherein long edge feed or short edge feed from said copy sheet feed trays is automatically selected to compliment long edge fed or short edge fed documents from said automatic document handler; and a finishing system adapted to receive the imaged copy sheets and present finishing options including: single staple position (portrait left, landscape left, portrait right and landscape right); dual staple position (left side portrait, left side landscape, top portrait and top landscape); no finishing (portrait and landscape); and dual staple position (left side portrait, right side portrait, top portrait, bottom portrait, left side landscape, right side landscape, top landscape and bottom landscape).

2. The reprographic device of claim 1, wherein said finishing system includes a graphic user interface.

3. The reprographic device of claim 2, wherein said finishing options are selectable from said graphic user interface.

4. The reprographic device of claim 3, wherein said graphic user interface includes a selection option of a single staple alignment parallel to the short edge of a copy sheet set or staple alignment parallel to the long edge of the copy sheet set in either portrait or landscape.

5. The reprographic device of claim 4, wherein said selection options are presented to a user in iconic graphics form.

6. The reprographic device of claim 5, wherein said iconic selection options are in dropdown form.

7. A printing apparatus including a finishing system that presents multiple finishing options to a user, comprising:

an automatic document handler that receives and feeds documents from a feed tray along a predetermined feed path with the documents positioned to be fed from the tray either short edge first or long edge first;

a scanning member positioned within said predetermined paper path to read an image on each document as it is passing and forward image data;

an image processor that receives the image data from said scanning member and processing it;

a plurality of copy sheet feed trays adapted to feed copy sheets to receive images thereon from said image processor, said copy sheet feed trays including trays that feed copy sheets short edge first or long edge first, and wherein long edge feed or short edge feed from said copy sheet feed trays is automatically selected to compliment long edge fed or short edge fed documents from said automatic document handler;

a finishing system adapted to receive the imaged copy sheets; and a graphic user interface adapted to be manipulated to present multiple finishing options.

8. The printing apparatus of claim 7, wherein said multiple finishing options include single staple position (portrait left, landscape left, portrait right and landscape right); dual staple position (left side portrait, left side landscape, top portrait and top landscape); no finishing (portrait and landscape); and dual staple position (left side portrait, right side portrait, top portrait, bottom portrait, left side landscape, right side landscape, top landscape and bottom landscape).

9. The printing apparatus of claim 7, wherein said finishing system includes a graphic user interface.

10. The printing apparatus of claim 9, wherein said finishing options are selected from said graphic user interface.

11. The printing apparatus of claim 10, wherein said finishing options are presented to a user in iconic graphics form.

12. The printing apparatus of claim 11, wherein said iconic selection options are in dropdown form.

13. The printing apparatus of claim 7, wherein said graphic user interface includes the selection option of a single staple alignment parallel to the short edge of a copy sheet set or staple alignment parallel to the long edge of the copy sheet set in either portrait or landscape.

* * * * *